US010563844B2

(12) United States Patent
Gladden et al.

(10) Patent No.: US 10,563,844 B2
(45) **Date of Patent: *Feb. 18, 2020**

(54) CONFIGURABLE LUMINAIRE WITH LIGHT SOURCES VARIABLY ORIENTED WITH RESPECT TO AN ARRAY OF CONCAVE MIRRORS

(71) Applicant: Glint Photonics, Inc., Burlingame, CA (US)

(72) Inventors: Christopher Gladden, San Mateo, CA (US); Andrew Kim, San Jose, CA (US); Peter Kozodoy, Palo Alto, CA (US); Barbara Kruse, San Francisco, CA (US)

(73) Assignee: GLINT PHOTONICS, INC., Burlingame, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/517,355

(22) Filed: Jul. 19, 2019

(65) Prior Publication Data

US 2019/0338921 A1 Nov. 7, 2019

Related U.S. Application Data

(63) Continuation of application No. 15/904,115, filed on Feb. 23, 2018, now Pat. No. 10,393,348.

(Continued)

(51) Int. Cl.

*F21V 21/00* (2006.01)
*F21V 14/04* (2006.01)

(Continued)

(52) U.S. Cl.

CPC ..... *F21V 14/04* (2013.01); *F21V 7/0008* (2013.01); *F21V 7/0083* (2013.01); *F21V 7/04* (2013.01);

(Continued)

(58) Field of Classification Search

CPC ..... F21V 14/04; F21V 7/0083; F21V 14/02

(Continued)

(56) References Cited

U.S. PATENT DOCUMENTS 4,975,814 A 12/1990 Schairer
5,924,785 A 7/1999 Zhang et al.

(Continued)

FOREIGN PATENT DOCUMENTS

EP 2589861 A2 5/2013
SE 527683 5/2006

(Continued)

OTHER PUBLICATIONS

PCT/US2018/019592, "International Search Report and Written Opinion", dated Jun. 7, 2018, 13 pages.

*Primary Examiner* — Laura K Tso

(74) *Attorney, Agent, or Firm* — Patent Law Group; Brian D. Ogonowsky

(57) ABSTRACT

An array of LEDs is supported by a support mechanism that both supports conductors leading to the LEDs and sinks heat from the LEDs. The support mechanism may be a transparent heat-conducting sheet or an array of cantilevered arms at different angles that support the LEDs and sink heat. This reduces the blockage of light. The LEDs are positioned generally in the focal plane of an array of concave mirrors that collimate the light. The LEDs and array of mirrors are translatable with respect to one another to steer the aggregate light beam to customize the emission. The LEDs may be variably oriented with respect to the associated mirror apertures so as to create different light beams emitted from different ones of the mirrors.

15 Claims, 12 Drawing Sheets

Related U.S. Application Data

(60) Provisional application No. 62/462,935, filed on Feb. 24, 2017.

(51) Int. Cl.

| | |
|---|---|
| ***F21V 14/02*** | (2006.01) |
| ***F21V 29/70*** | (2015.01) |
| ***F21V 29/503*** | (2015.01) |
| ***F21V 23/00*** | (2015.01) |
| ***F21V 7/04*** | (2006.01) |
| ***F21V 7/00*** | (2006.01) |
| *F21Y 115/10* | (2016.01) |
| *F21Y 105/16* | (2016.01) |
| *F21Y 105/10* | (2016.01) |

(52) U.S. Cl.
CPC ..... *F21V 14/02* (2013.01); *F21V 23/003* (2013.01); *F21V 29/503* (2015.01); *F21V 29/70* (2015.01); *F21Y 2105/10* (2016.08); *F21Y 2105/16* (2016.08); *F21Y 2115/10* (2016.08)

(58) Field of Classification Search
USPC ..... 362/285, 277, 280, 232
See application file for complete search history.

(56) References Cited

U.S. PATENT DOCUMENTS

| | | | | |
|---|---|---|---|---|
| 6,722,777 | B2 | 4/2004 | Erber | |
| 6,886,962 | B2 | 5/2005 | Suehiro | |
| 7,131,760 | B2 | 11/2006 | Mayer et al. | |
| 7,316,496 | B2 | 1/2008 | Wu et al. | |
| 8,079,737 | B2 | 12/2011 | Wang et al. | |
| 8,393,761 | B2 * | 3/2013 | Nikolaus ..... | G02B 19/0066 362/241 |
| 9,841,162 | B2 | 12/2017 | Pickard et al. | |
| 2002/0024808 | A1 | 2/2002 | Suehiro et al. | |
| 2003/0156410 | A1 | 8/2003 | Ter-Hovhannisian | |
| 2006/0139918 | A1 * | 6/2006 | Dolgin ..... | G02B 3/00 362/232 |
| 2007/0279910 | A1 | 12/2007 | Lin | |
| 2011/0085326 | A1 | 4/2011 | Jouffrieau | |
| 2018/0087748 | A1 | 3/2018 | Gladden et al. | |

FOREIGN PATENT DOCUMENTS

| | | | |
|---|---|---|---|
| WO | 8905524 | A1 | 6/1989 |
| WO | 2008102287 | A1 | 8/2008 |
| WO | 2012167799 | A1 | 12/2012 |
| WO | 2013019424 | A1 | 2/2013 |
| WO | 2015048555 | A1 | 4/2015 |

* cited by examiner

CONFIGURABLE LUMINAIRE WITH LIGHT SOURCES VARIABLY ORIENTED WITH RESPECT TO AN ARRAY OF CONCAVE MIRRORS

CROSS-REFERENCE TO RELATED APPLICATIONS

This application is a continuation of U.S. patent application Ser. No. 15/904,115, filed Feb. 23, 2018, which claims priority to U.S. provisional application Ser. No. 62/462,935, filed Feb. 24, 2017, by Christopher Gladden et al, incorporated herein by reference.

GOVERNMENT LICENSE RIGHTS

This invention was made with Government support under contract DE-AR0000332 awarded by the Advanced Research Projects Agency—Energy (ARPA-E), a division of the Department of Energy. The Government has certain rights in the invention.

FIELD OF THE INVENTION

The present invention relates to general lighting, such as for a home or office, and, in particular, to a luminaire with a controllable emission using an array of light emitting diodes (LEDs) and an array of collimating mirrors.

BACKGROUND

Various types of prior art lighting structures will be described that generally describe a set of LEDs and a set of lenses. The LEDs and lenses are translatable relative to each other to steer a beam of light or to otherwise customize the emission.

Directional lighting is important in many contexts, for example in providing illumination for task areas in a workplace, for highlighting objects in a retail space or an artistic exhibition, for illuminating walkways and roadways outdoors, and many more applications. Commonly-used light fixtures that provide the option to adjust lighting directionality typically include an illumination "head" that can be swiveled to point in a desired direction. Multiple heads are often included in a single light bank or in a configurable system such as a track lighting system. Adjustments to the angular spread of the output beam from each head is typically achieved by installing a bulb with the desired output beam width.

A planar adjustable luminaire design is disclosed in Joseph Ford's PCT/US2014/057873, entitled "Microstructured Waveguide Illuminator," and William M. Mellette, Glenn M. Schuster, and Joseph E. Ford's paper entitled, "Planar waveguide LED illuminator with controlled directionality and divergence," Optics Express vol. 22 No. S3, 2014. This design offers the advantage of a compact low-profile form factor with wide adjustability. The luminaire uses an edge-illuminated lightguide with periodic extraction features that is mated to an array of lenses or reflectors ("focusing elements"). By adjusting the relative location of the extraction features and the focusing elements, the direction of the beam can be steered and the angular width of the output beam can be adjusted.

FIG. 1 is an exploded view of such a design. It includes a lightguide 10 that is edge-lit by a light source 11, in this example composed of light emitting diodes (LEDs) 17 and associated coupler optics 18. The lightguide 10 may be of a continuous-mode type as shown in FIG. 1 or a stepped-mode type. In either case, the lightguide 10 includes a periodic array of extraction features 12. These features 12 reflect or scatter light so that it is no longer trapped in guided modes of the lightguide 10 and instead exits the lightguide 10 to interact with the array 14 of focusing elements 15. The extraction features 12 shown in FIG. 1 are reflective and are preferably shaped as prisms to deflect guided light toward the focusing elements 15, but may also be shaped as cones, hemispheres, or other shapes. They lie approximately in the focal plane of the focusing elements 15 so that light scattered by the extraction elements 12 is substantially collimated by the focusing elements 15. The focusing elements 15 are all in a single plane in the array 14. The focusing elements 15 may be refractive lenses that transmit the substantially collimated light, or may be curved reflectors that reflect back collimated light so that it transits through the lightguide 10 before exiting the luminaire into the environment.

FIG. 2 is a cross-section view of a portion of the adjustable luminaire of FIG. 1, showing the array 14 composed of dielectric-filled reflective focusing elements 15 with a reflective coating 19, and two associated extraction features 12. Light from the light source 11 is guided in the lightguide 10. Some of the light is deflected by extraction features 12 to exit the lightguide 10 and enter the focusing element array 14. These light rays 13 reflect off the reflective coating 19, becoming partially collimated, and then transit through the lightguide 10 before exiting the luminaire as the steered output light beam 16. The light rays emanating from the light source 11 and traveling within the lightguide 10 are not depicted in FIG. 2 in the interest of visual clarity; only the example light rays 13 reflected by one of the focusing elements 15 are shown.

Each individual focusing element 15 serves to substantially collimate the light reflected or scattered by the corresponding extraction feature 12 so that it is emitted into the environment as a directional beam 16 of narrow angular width. Control over the directionality of the individual beams 16 is achieved by varying the relative location of the extraction feature 12 and the focusing element 15. This can be achieved by translating the array 14 of focusing elements 15 relative to the extraction features 12 in the lightguide 10. As the location of the extraction feature 12 moves from the center of the focusing element 15 to the edge, the output beam 16 is steered from perpendicular to the plane of the lightguide 10 to a high angle.

If all focusing elements 15 in the array 14 bear the same orientation relative to their corresponding extraction features 12, then all the output beams 16 will point in the same direction. In that case, all the focusing elements are contributing to a narrow aggregate beam pointed in a single direction. Alternatively, if the focusing elements 15 in the array 14 are twisted relative to the array of extraction features 12, then each of the output beams 16 will point in a somewhat different direction. In that case, the output aggregate beam is the sum of the differently-pointed beams and results in a wider aggregate beam. Therefore, independent control over beam pointing and aggregate beam width is provided by translating and twisting the relative position of the focusing element array 14 and the extraction element array.

The prior art describes several implementations of this design, including the use of motorized actuators and a control system to provide remote control over the output characteristics of the adjustable luminaire. The prior art also describes the use of a switchable material in the lightguide that provides for pixelated control over the location and presence of the extraction features. The prior art describes a mechanism for controlling this whereby a layer of liquid crystal material with electrically-adjustable refractive index is placed on the face of the lightguide. In its low-refractive-index state, this material acts as cladding to keep light confined within the lightguide. Pixelated electrodes allow it to be locally switched to a high-refractive-index state, allowing light to locally interact with a tilted mirror array and be ejected from the lightguide. This provides a mechanism for local control over the location of the extraction feature. The design can be implemented with a stationary lens array to provide a steerable luminaire design with no moving parts.

FIG. 3 depicts a luminaire design that includes an array of light emitters 30, each coupled to a focusing element 31 (in this case, reflective focusing elements). The focusing elements 31 are depicted as transparent so as to view the light emitters 30. The light emitters 30 are shown below the focusing elements 31, and the reflected light is directed back towards the light emitters 30. No lightguide is needed. The light emitters 30 may be of any type, but are preferably LEDs or laser diodes for compactness and efficiency. Vertical-cavity surface-emitting laser diodes (VCSELs) are another option for the light emitters 30. In all cases, the light emitters 30 are connected in a network electrically and supported by metal heat spreading supporting structures 32. The electrical connections bring electrical power to the light emitters 30 to drive them, and the heat spreading supporting structures 32 are used to route heat away from the emitters 30 to reduce operating temperature. The electrical connections and heat spreading supporting structures 32 may be optionally combined into a single structure or even combined into a single element. This is shown in the example system of FIG. 3, where a strip of metal-core printed circuit board (MCPCB) (forming the heat spreading support structures 32) connects individual light emitters 30 in a line, providing both electrical connections and a heat spreading element.

It is advantageous to design the system so that the emitting area of the light emitter 30 is much smaller than the area of the focusing element 31, enabling the focusing element 31 to produce a beam of a narrow angular width. For example, the diameter of the focusing element 31 may be approximately 5 to 20 times the diameter of the light emitting area of the emitter 30.

When implemented with a reflective focusing element array 34 (an array of concave mirrors), it is also advantageous to minimize the area of the electrical connections and heat-spreading support structures 32, as these will shadow the reflected light and reduce system optical efficiency. In FIG. 3, the heat spreading support structures 32 span the entire width of each focusing element 15, so the resulting aggregate shadow may be significant and can create a perceived artifact on an illuminated object.

The direct-lit design uses the arrayed light emitters 30 in place of a lightguide and extraction features used in the edge-lit designs. It shares the same adjustable functionality, however. Aggregate beam steering is achieved by translating the array of focusing elements 31 relative to the array of light emitters 30, and aggregate beam broadening can be achieved by twisting the array of focusing elements 31 relative to the array of light emitters 30.

An advantage of the direct-lit design is that it can be implemented with high optical efficiency in a small form factor. In contrast, the edge-lit design requires a row of LEDs of a length needed to generate all the required light within the lightguide.

While the prior art described above provides for major advantages compared to conventional steerable luminaires, it still suffers from various limitations affecting implementation for specific applications. These include: i) reduced optical efficiency and non-uniform aggregate beam due to shadowing from electrical connections and heat-spreading elements; ii) limited flexibility to adjust aggregate beam shape; and iii) loss of optical efficiency due to cross-talk during beam steering.

SUMMARY

Various types of controllable emission luminaires are described.

In one embodiment, an array of LEDs is supported by a support mechanism that both supports conductors leading to the LEDs and sinks heat from the LEDs. The support mechanism may be a transparent heat-conducting sheet or an array of cantilevered arms that support the LEDs and sink heat. The LEDs are positioned generally in the focal plane of an array of concave mirrors that collimate the light. The LEDs and array of mirrors are translatable with respect to one another to steer the aggregate light beam to customize the emission. Due to the configuration of the cantilevered support mechanism, there is less blockage of light emitted by the mirrors so there is improved efficiency and less shadowing.

The cantilevered support arms may be at different angles so that the resulting shadows within the beams do not overlap, eliminating perceivable artifacts from the light obstructions.

In another embodiment, thin transparent light guides emit the light toward the mirror array so no heat sink or conductors are required to be overlying the mirror array. Shadows are greatly reduced.

In another embodiment, multiple LEDs are positioned over each mirror in the mirror array, and the combination of LEDs illuminated over each mirror is used to steer the aggregate light beam from the luminaire. Each group of LEDs may substantially span across the entire width of a single mirror. Highly complex emission patterns may be generated, since each mirror may experience a different pattern of energized LEDs. In this case, the positions of the LED array and mirror array may be fixed in one or both axes since the aggregate beam is steered by energizing the selected LEDs.

In another embodiment, a linear arrangement of LEDs spans across a linear arrangement of mirrors, and the entire system may pivot to direct the light in the steering axis orthogonal to the long axis of the array of LEDs.

The LEDs may have a variety of lenses affixed to them to further shape the beam.

Other embodiments are described.

BRIEF DESCRIPTION OF THE DRAWINGS

FIGS. 4B and 4C show cantilevered arms supporting the LEDs. The LED array or mirror array is movable to create a steerable aggregate beam.

Elements that are the same or equivalent in the various figures are labeled with the same numeral.

DETAILED DESCRIPTION

This disclosure describes a number of inventions that offer improvements to the design of the prior art direct-lit, configurable-beam luminaire. Although white light LEDs are used in the examples, the light emitters may be any other type of solid state light emitter and may comprises different color light emitters for customizing a color temperature.

In one embodiment, a direct-lit luminaire has a reflective focusing element array paired with an array of LEDs, providing multiple independently-adjustable beams. The beams may combine to form a wide variety of light emission patterns. The aggregate beam steering may be achieved by translating the array of focusing elements relative to the array of LEDs, and aggregate beam broadening may be achieved by twisting the array of focusing elements relative to the array of LEDs.

Figure 1:
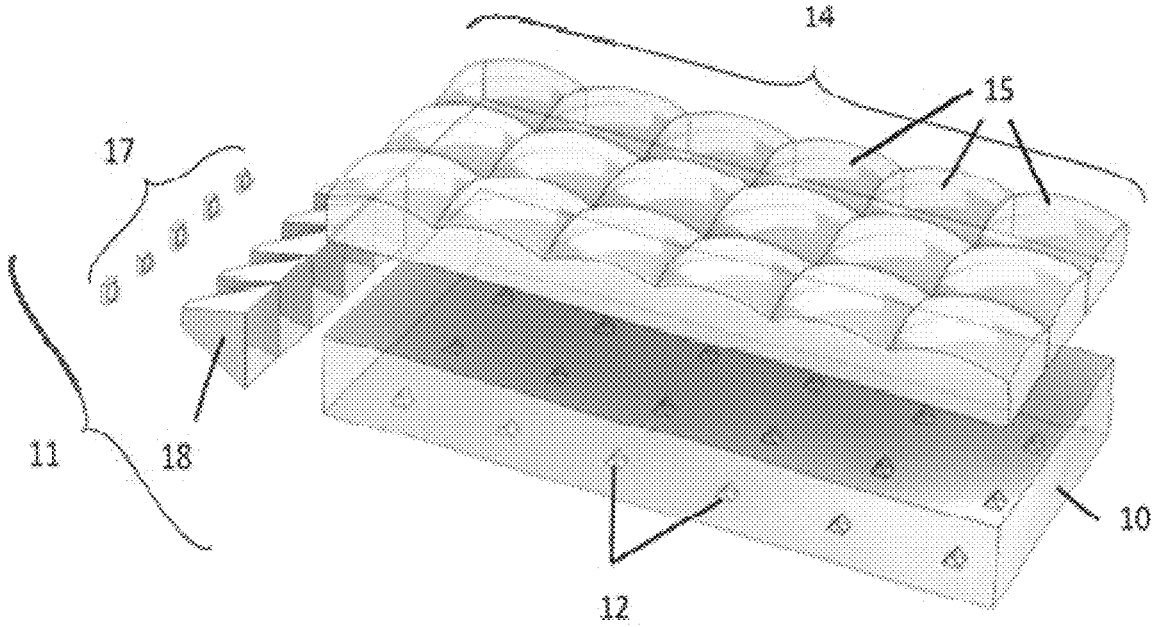
FIG. 1 (PRIOR ART)
FIG. 1 is an exploded perspective view of a prior art luminaire where LEDs are optically coupled to a side of a lightguide, and reflectors in the lightguide direct the light toward an array of collimating mirrors. The reflectors are in the focal plane of the mirrors. By translating the collimating mirrors relative to the lightguide, the aggregate light beam is steerable.
Figure 2:
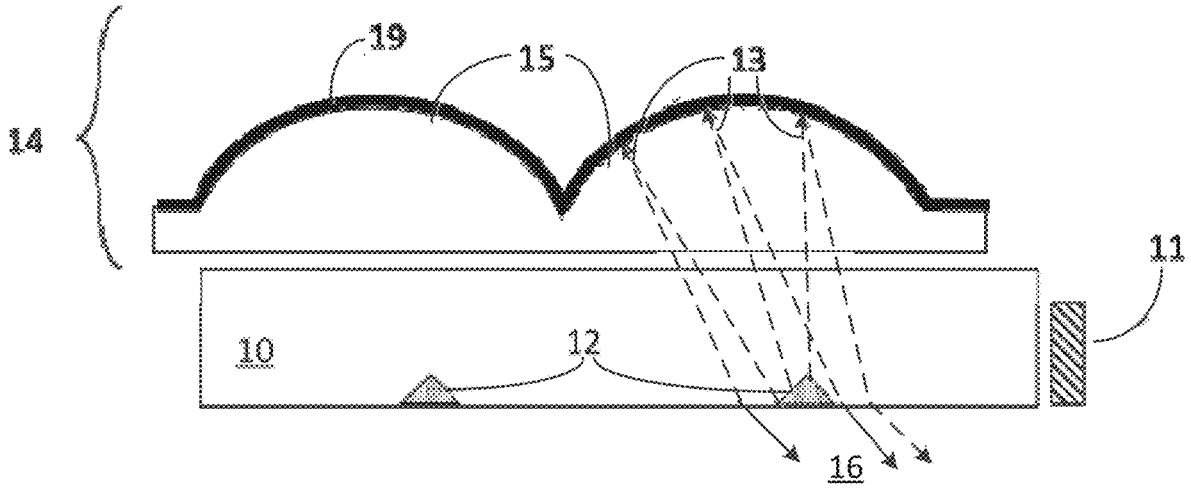
FIG. 2 (PRIOR ART)
FIG. 2 is a cross-section of the luminaire of FIG. 1 showing the light from the reflectors impinging on the focusing mirrors and being directed back through the lightguide at a selectable angle.
Figure 3:
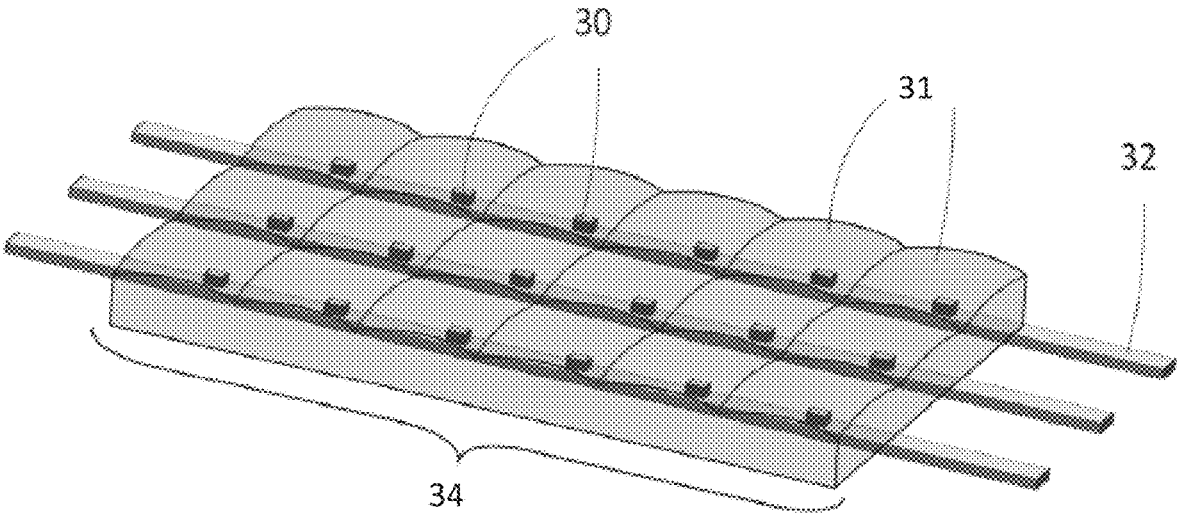
FIG. 3 is a perspective view of a prior art variation of the luminaire of FIG. 1, where the LED array is directly positioned in the focal plane of the mirror array and no lightguide is used.

One improvement of the prior art direct-lit structure of prior art FIG. 3 is by reducing the blockage of the light output path by the LED supporting structure. Thus, more light exits the luminaire, and shadows are reduced.

Minimizing the Size of the Support Structures and Varying the Orientation of Support Structures for the Light Source Arrays FIGS. 4A-4C, 5A, and 5B illustrate examples of reducing the area of opaque support structures that support the LEDs in the focal plane of the focusing elements, support the electrically conductive traces for the LEDs, and sink heat from the LEDs.

There is a general design trade-off, where the opaque support structures should be as narrow as possible to minimize their optical obstruction, while the opaque support structures should be as substantial as possible to maximize their thermal conductivity and mechanical support.

Figure 4A:
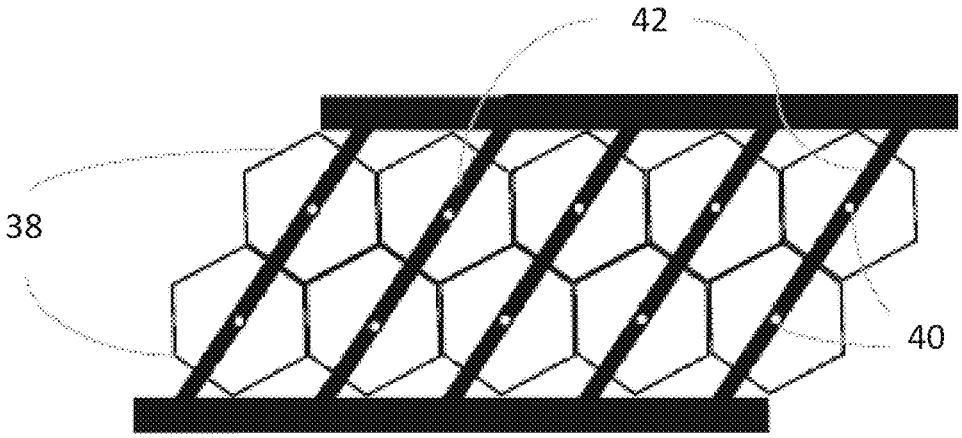
FIGS. 4A-4C are front views of arrays of LEDs, supported by different designs of support structures that provide electrical conductors and heat sinking, where the LEDs are located in the focal plane of a collimating mirror array.

FIG. 4A illustrates an array of focusing elements 38 having a hexagonal aperture. The focusing elements 38 may be concave mirrors filled with air but are preferably concave mirrors comprised of a reflective coating on a transparent solid form (made of polymer, glass or another transparent material) with a planar surface opposite the reflective coating. The reflective surface of the concave mirrors may be smooth, or feature some roughness or faceting. The focusing elements 38 generally collimate light from the LEDs 40, where the LEDs 40 are positioned at the focal plane of the mirror array. The reflected light passes around the LEDs 40 and support structure 42 to the environment. The support structure 42 may be metal for good heat sinking. Electrically conductive traces fabricated onto the support structure 42 with an insulating interlayer connect the LEDs 40 in a control circuit. Either the support structure 42 or the array of focusing elements 38 is moved to control the beam shape and exit angle. Note that the support structure 42 spans across the entire aperture of the focusing elements 38. It is desirable to reduce the light blockage by the support structure 42.

Figure 4B:
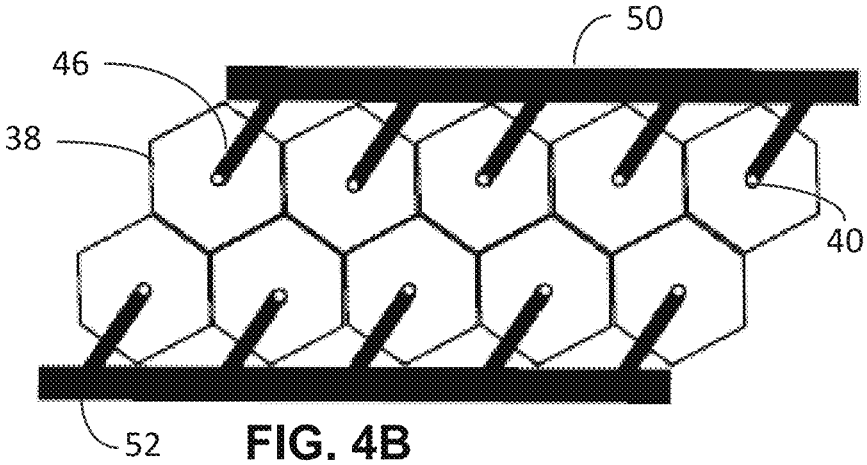

In FIG. 4B, the opaque support structure 46 for the LEDs 40 only extends over half the width of the apertures of the focusing elements 38, since the support structure 46 for each LED 40 forms a cantilevered arm over the focusing elements 38 and is supported by the larger metal busses 50 and 52. Therefore, there is one half of the light obstruction compared to the design of FIG. 4A. Additionally, the shadows cast by the opposite support structures 46 in FIG. 4B do not add to each other since the support structures 46 are cantilevers over opposite portions of the focusing elements 38. So, not only are the shadows reduced by half, but the shadows from the two rows of focusing elements 38 do not overlap, greatly reducing any perceivable artifacts.

Also in FIG. 4B, the cantilevered arms extend over the flat edges of the hexagonal apertures, approximately perpendicular to the flat edge. Therefore, the cantilevered arms cover less than half the widest diameter of the apertures to reduce the light blockage.

Figure 4C:
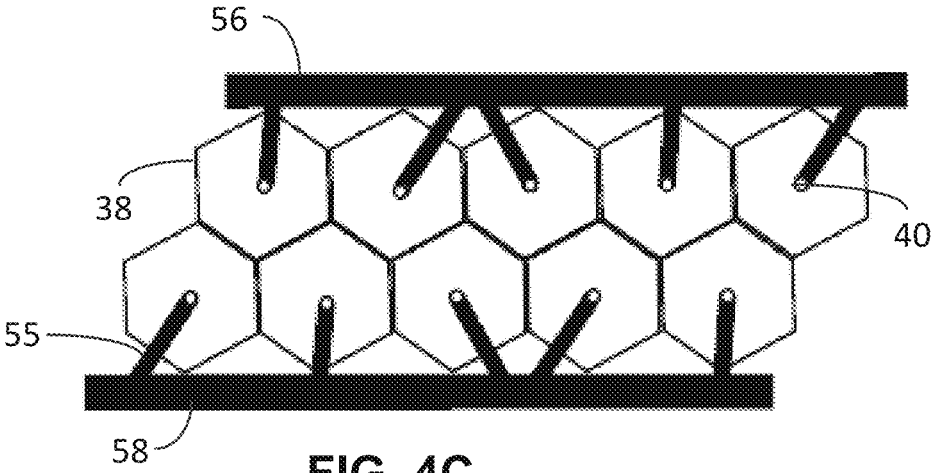

If the metal heat-sinking supporting structures are arranged regularly, for example spanning the rows, columns, or both rows and columns of the mirror array, the optical impact of their obstructions over each focusing element 38 may reinforce each other and be visible in the far-field aggregate beam. The reinforcement of optical obstructions can be reduced by varying the orientation of the structures across the light source array, as shown in FIG. 4C. In FIG. 4C, the cantilevered support structures 55 for the LEDs 40 are variously angled to minimize overlap of the shadows that each creates. This virtually eliminates any perceivable artifacts from the cantilevered support structures 55. The cantilevered support structures 55 conduct heat to the larger metal busses 56 and 58. Variously-oriented support structures may also be implemented in a non-cantilevered design where the support structures span the entire aperture of the mirrors.

In FIGS. 4A-4C, either the support structure or the mirror array is translated to steer the beam. In FIGS. 4A-4C, the LEDs 40 are shown centered over the associated focusing elements 38, but the LEDs 40 may be located at any position over the focusing elements 38 to achieve the desired aggregate beam emission pattern.

In FIGS. 4A-4C, only two rows of focusing elements 38 are shown, but there may be any number of rows of focusing elements 38, with an associated LED support structure for each row. For example, for the design of FIG. 4C, there may be another row of mirrors, and the support structure 56 may support another set of cantilevers for the LEDs over the added mirror row.

Figure 5A:
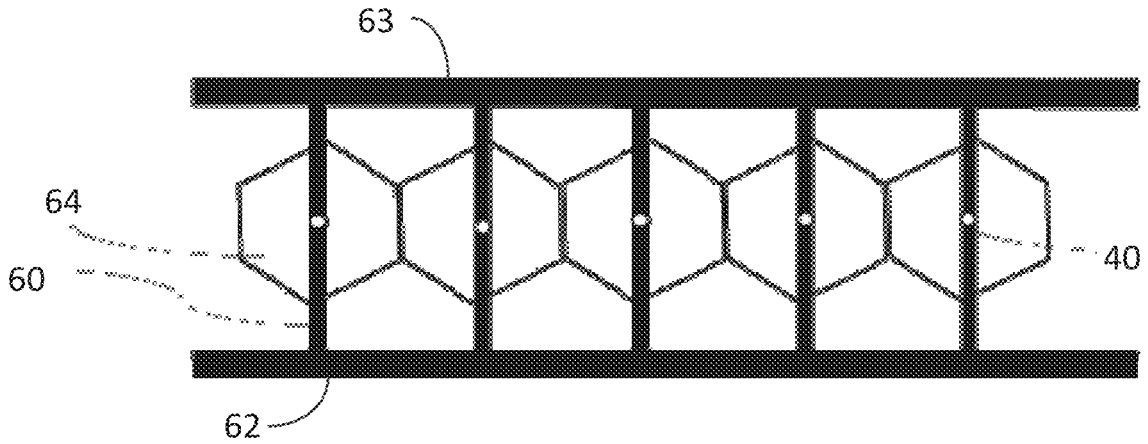
FIG. 5A illustrates a linear array of mirrors and a linear array of LEDs.

FIG. 5A shows a luminaire with a 1×N array (a single row) of LEDs 40 and focusing elements 64. In this example, support structures 60 span the full aperture of the focusing elements 64, so that heat is withdrawn from each LED in opposite directions to a much larger metal bus 62 and 63.

Varying the Orientation of Light Emitters

Figure 5B:
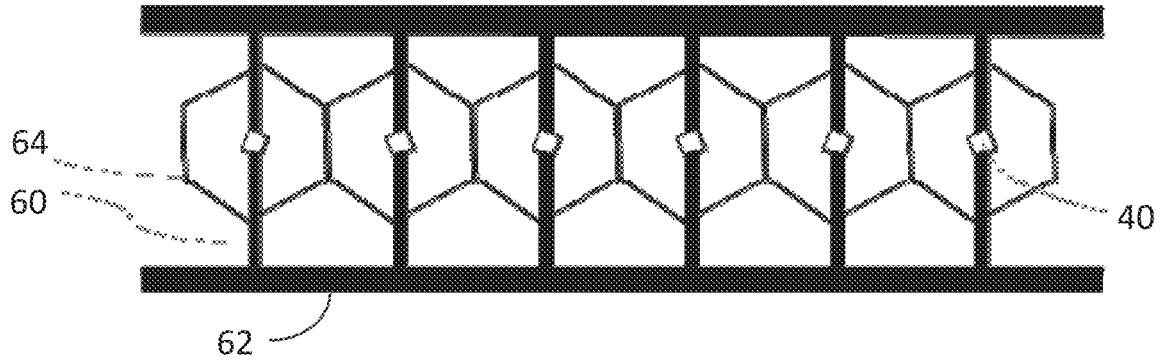
FIG. 5B illustrates how square LEDs may be mounted with respect to collimated mirrors in different orientations.

While some LEDs have a round light emitting surface, most high-power LEDs have light emitting surfaces that are square or rectangular, as shown in FIG. 5B. A square LED 40 used in an imaging optical system, such as the luminaires described herein, will project a light beam with a square shape, unless special measures are taken to modify the shape of the light beam.

In a system with an array of multiple square LEDs 40 whose projected light beams superimpose into an output aggregate light beam, the rotational orientation of the square LEDs 40 around the normal line that intersects the optical center of the square LEDs 40 may be varied within the array. The superposition of square beams projected with varying orientation results in output aggregate beam shapes that are increasingly complex polygons, approaching a circle as the number of orientations increases. Aberrations and scatter in real optical systems tend to soften the edges and corners of projected beams, such that the output aggregate beam may appear substantially circular with a relatively small number of square LED 40 orientations.

FIG. 5B shows an array of square LEDs 40 with two orientations that are 45° apart, which results in an output aggregate beam in the shape of an eight-point star. Another array with four orientations that are 15° apart results in an output aggregate beam in the shape of a sixteen-point star.

If square LEDs are placed on the support structures with a consistent orientation with respect to the shape of the structures, but the orientation of the structures is varied across the light source array, such as shown in FIG. 4C, then the square LEDs will vary in orientation across the light source array as well. In the example of FIG. 5B, the orientation of the square LEDs 40 are varied independently from the orientation of the support structures 60, whether the orientation of the support structures 60 is or is not varied across the light source array.

Transparent Support Structures for Light Source Arrays

Figure 6:
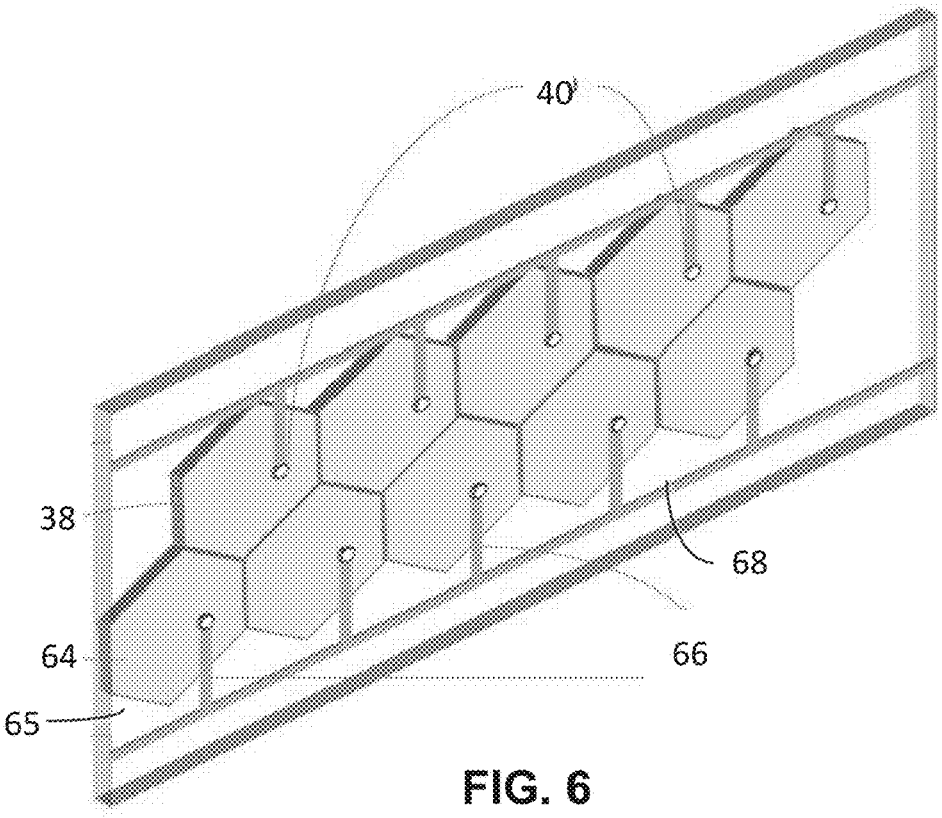
FIG. 6 is a perspective view of an array of LEDs and their electrical conductors supported on a transparent sheet in the focal plane of a collimating mirror array, where the transparent sheet or the mirror array is translatable for steering the aggregate beam.

As shown in FIG. 6, the heat-sinking support structure can also be constructed of a thermally-conductive transparent sheet 65, such as plastic, glass, ceramic, or crystal. Therefore, there is no light obstruction by the heat-sinking support structure. Metal traces 66 printed on the transparent sheet 65 supply power to the LEDs 40 via larger trace busses 68. The metal traces 66 can be very narrow and not substantially obstruct the light path. The traces 66 can even be formed of a transparent conductor. Two key limitations are that most transparent materials have very low thermal conductivity, e.g. glass and acrylic, or have high thermal conductivity but are very expensive, e.g. sapphire, aluminum nitride, and diamond. In applications where the operating power of the light sources is low, transparent sheet 65 may be made of a transparent material of limited thermal conductivity, e.g. glass. In applications where it is valuable to have a very hard front surface, transparent sheet 65 may be made of a transparent material of high thermal conductivity, e.g. sapphire.

Figure 11:
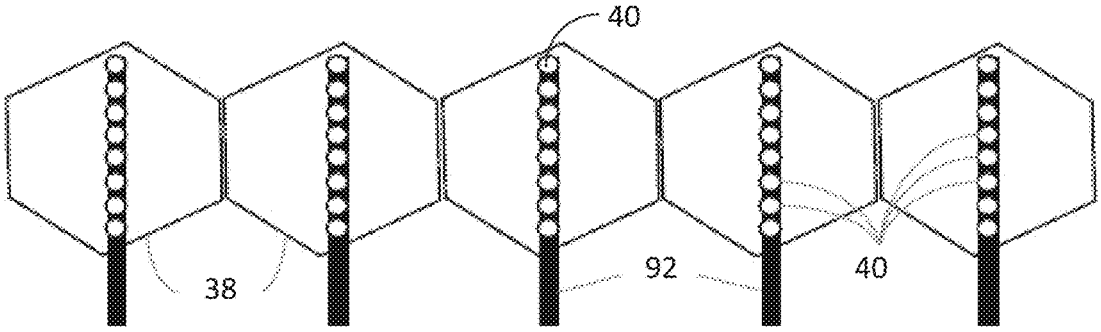
FIG. 11 is similar to FIG. 10 but the linear arrays of LEDs are arranged on individual support structures to facilitate separate control over which LEDs are energized in each linear array of LEDs.

As with all embodiments, the features of any of the embodiments may be combined, where feasible. For example, the metal traces 66 in FIG. 6 may be at various angles, such as shown in FIG. 4C; the rectangular LEDs may be at different orientations, such as shown in FIG. 5B; the relative movement of the mirrors and LEDs may be controlled by an actuator (e.g., FIG. 18); or multiple LEDs per aperture may be used to control the beam shapes without an actuator, as shown in FIGS. 11 and 12.

Light Guided Sources

A different approach to reduce the optical obstruction of the structures is to replace the array of light sources with an array of lightguides that are coupled to light emitters located outside the optical path of the focusing elements and that have light extraction features associated with the focusing elements that act as the light sources.

Figure 7:
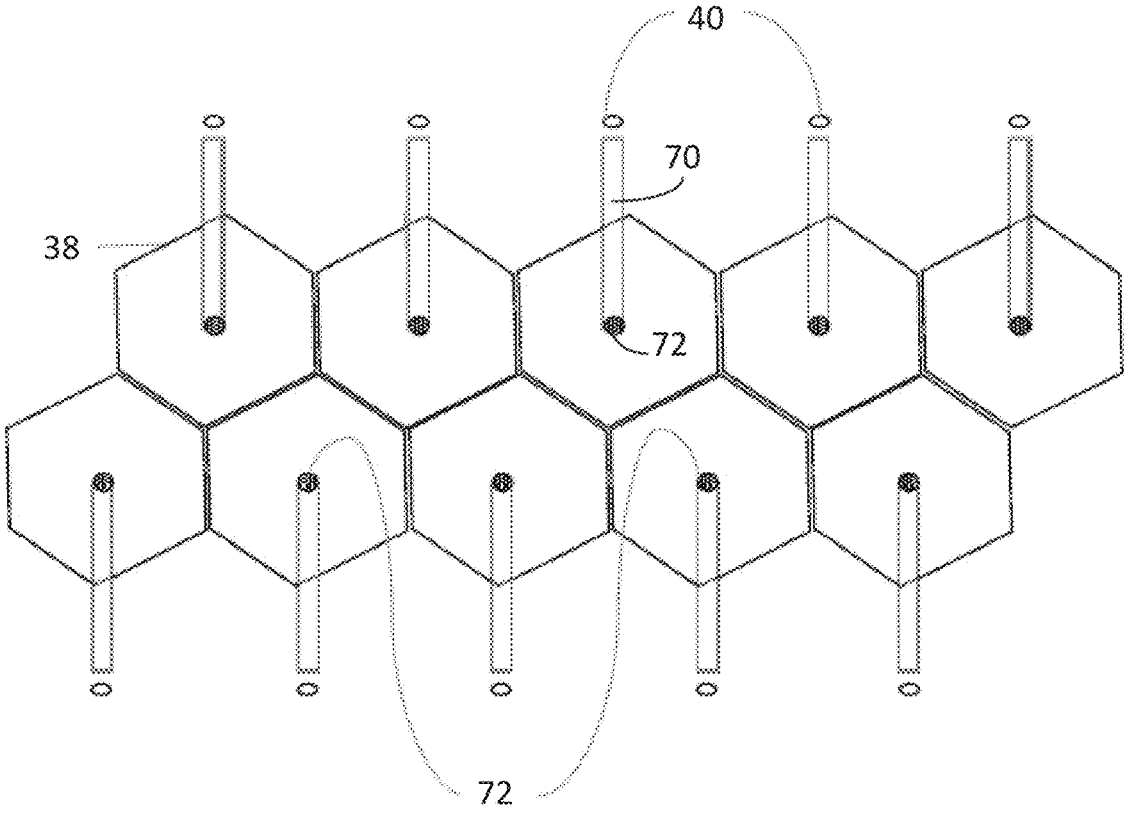
FIG. 7 is a front view of a luminaire where LED light is transmitted to the focal plane of a collimating mirror array via lightguide rods, so as to minimize light blockage.

FIG. 7 shows one embodiment featuring an array of lightguide rods 70, each of which is coupled to one or more LEDs 40 at one end and has a light extraction feature 72 at the other end associated with a focusing element 38. The lightguide rods 70 are preferably as narrow as possible to accommodate the LEDs 40, so that all the light can be extracted with a small light extraction feature 72 in order to provide a narrow output beam. The lightguide rods 72 may be made of a transparent material such as plastic or glass, and the extraction feature 72 may be an angled reflector, light scattering feature, or other structure that causes some of the light within the lightguide rods 70 to exit locally.

Figure 8:
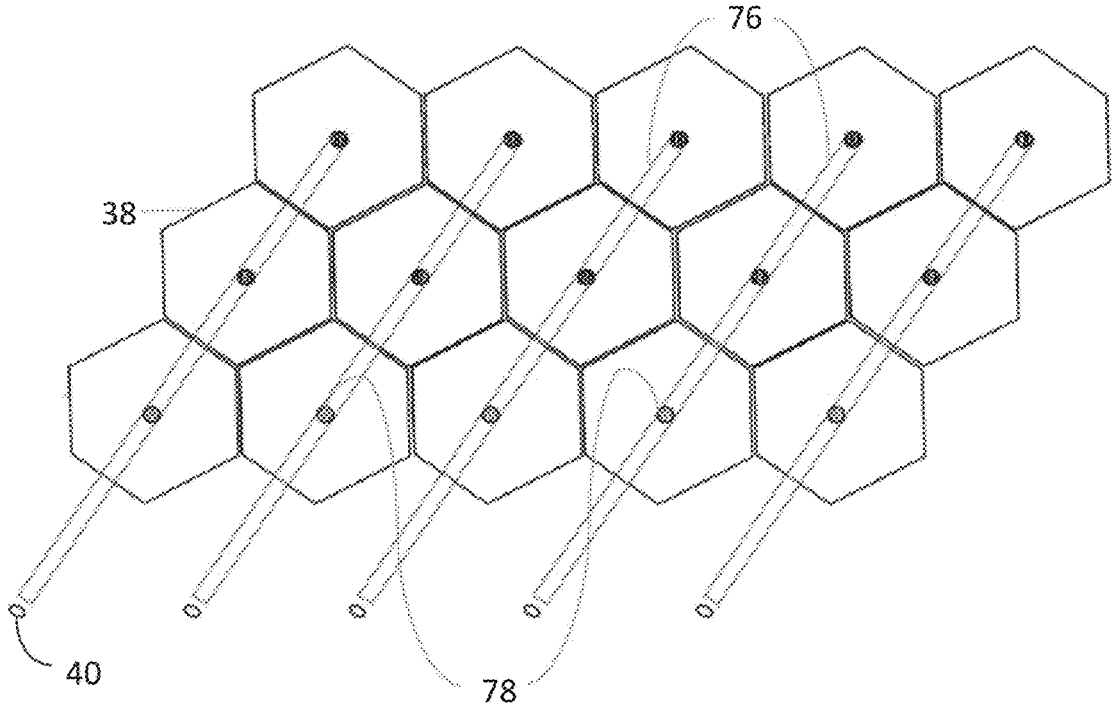
FIG. 8 is similar to FIG. 7 but each lightguide rod extends over multiple collimating mirrors and light extraction features in the rods emit the LED light toward the associated mirrors.

FIG. 8 shows another example using an array of lightguide rods 76, each associated with one or more LEDs 40, with each lightguide rod 76 having multiple light extraction features 78 incorporated along its length, with each extraction feature 78 associated with an individual focusing element 38. Another example would feature lightguides rods that have a mode volume that steps down in multiple steps that are associated with several focusing elements 38.

Figure 9:
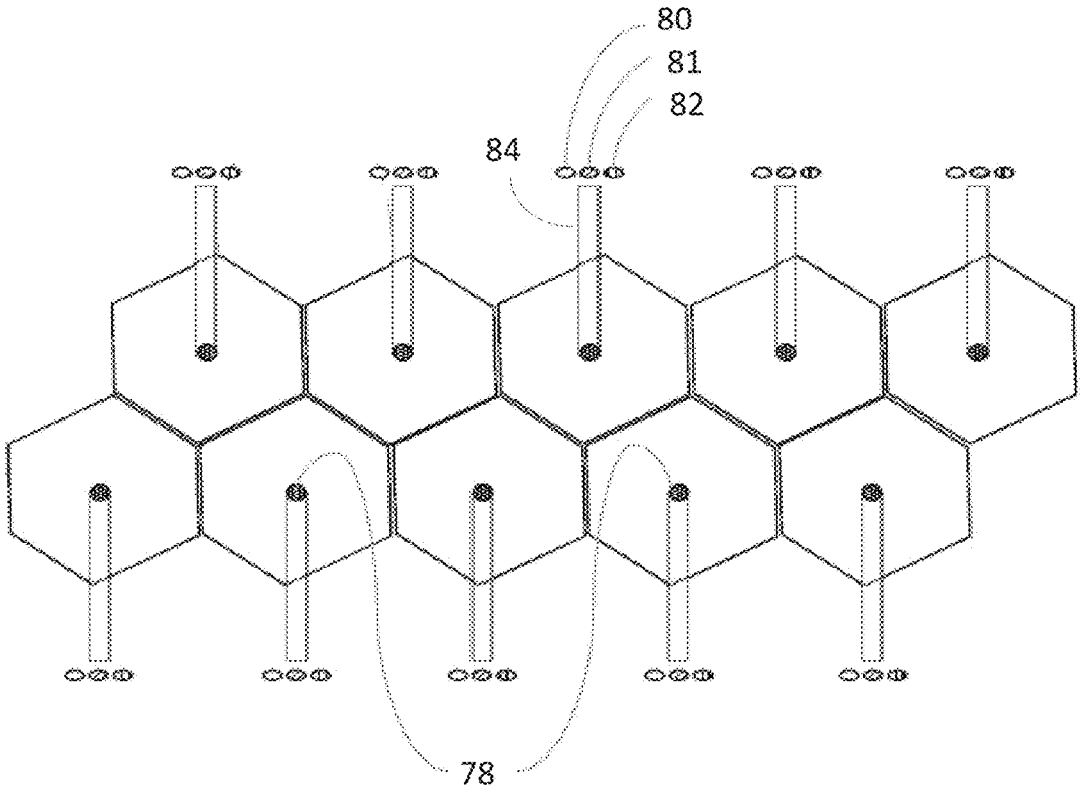
FIG. 9 is similar to FIG. 7 but different color LEDs are optically coupled to each lightguide rod to vary the colors emitted.

FIG. 9 shows an additional benefit of using lightguide rods, where multiple LEDs 80, 81, and 82 of different colors (e.g., RGB) are coupled into a single lightguide rod 84 to provide color tunability without increasing the effective light emitting surface area that each focusing element sees as a light source. Multiple emitters of different colors may be also used as a light source in a direct-lit luminaire without light guides, but the effective light emitting surface area of the light source is increased to the total area of the multiple emitters and the multiple colors will not be precisely aligned.

Sub-Arrays of Multiple Light Emitters in a Direct-Lit Configurable Luminaire

A different approach to provide for configurability of a light emission in the direct-lit configurable luminaire is to provide a sub-array of multiple LEDs 40 associated with each focusing element 38, as shown in FIGS. 10-13.

Figure 10:
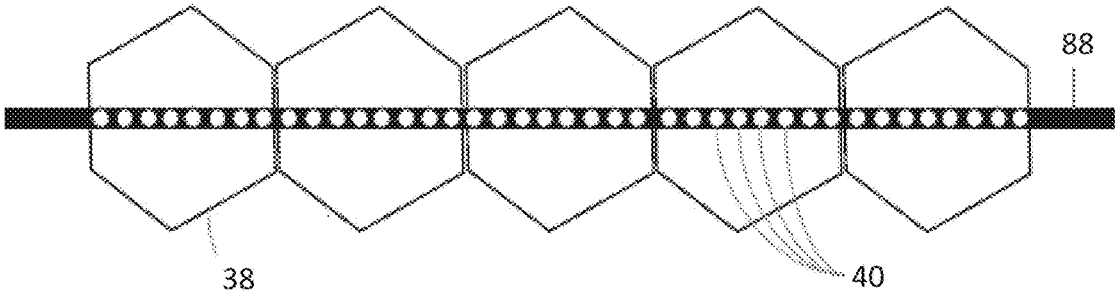
FIG. 10 is a front view of a portion of a luminaire that includes a linear row of collimating mirrors and a linear row of LEDs spanning the widths (apertures) of the collimating mirrors. The selection of which LEDs to energize determines the angle(s) of the light beam after reflection from the collimating mirrors so the aggregate beam is steerable. The LEDs and collimating mirrors may be fixed in position, or the collimating mirrors may be allowed to translate in the axis orthogonal to the linear rows of LED.

In FIG. 10, multiple substantially identical LEDs 40 are supported as a linear array on a heat-sinking support structure 88, which also supports metal traces for selectively powering the LEDs 40. Multiple LEDs 40 span the aperture of each focusing element 38. Each focusing element 38 is associated with a sub-array of LEDs 40. Selectively varying which LED 40 is turned on in each sub-array overlying an associated focusing element 38 effectively moves the location of the light source relative to the focusing element 38 to steer the beam in one axis. Thus, no mechanical translation of the light sources relative to the focusing elements 38 is required to steer the aggregate beam in this axis. In a variation of the design, the LEDs 40 in each sub-array may have different directional characteristics so that the LEDs 40 may be energized to steer the beam in any X-Y direction.

FIG. 11 illustrates a related luminaire where the heat-sinking support structure 92 associated with each focusing element 38 is cantilevered, and the support structures 92 are parallel to each other. All the support structures 92 may be connected to a bus (not shown). The beam is steered by selecting one or more LEDs 40 to energize for each focusing element 38. In FIGS. 10 and 11, combinations of the LEDs 40 may be energized to create complex emission patterns. Different combinations of LEDs 40 in the different sub-arrays may be energized.

Figure 12A:
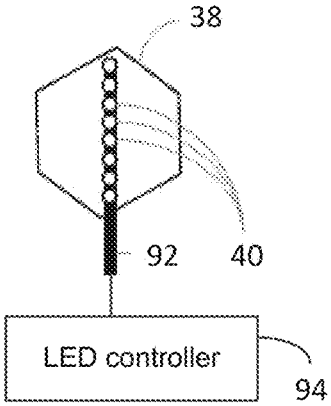
FIGS. 12A-12D show the same concave collimating mirror from FIG. 11, where different combinations of the LEDs are illuminated to cause the beam output from the collimating mirror to be steered and/or have a different shape.
Figure 12B:
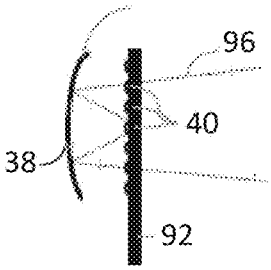
Figure 12C:
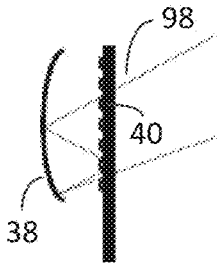
Figure 12D:
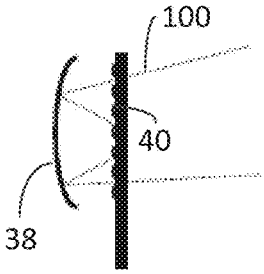

FIG. 12A shows a focusing element 38 and its sub-array of LEDs 40. An LED controller 94 is coupled to all the LEDs 40 via thin metal traces on the support structure 92 to selectively energize any combination of LEDs 40. The LED controller 94 may be manually controlled by the user via a manual controller or may be controlled by a microprocessor. FIGS. 12B-12D are side views of the concave mirror focusing element 38 and the effects of energizing different LEDs 40 in the sub-array to steer the beam. FIG. 12B shows the effect of energizing the LED 40 that is centered with respect to the focusing element 38 at its focal point. The resulting beam 96 is generally collimated and normal to the plane of the focusing elements 38. In FIG. 12C, the energized LED 40 is off-center so the resulting beam 98 is at an angle with respect to the plane of the focusing elements 38. In FIG. 12C, two LEDs 40 are energized to cause two beams to create an aggregate beam 100 that is broader and steerable by the selection of the LEDs 40. Further, all the LEDs 40 in the sub-array may be energized at any brightness level to create the broadest beam.

The benefit of this different approach is that beam steering and broadening are accomplished in one axis without mechanical actuation, improving the minimum physical dimensions, power consumption, noise, and reliability of the luminaire.

If the LEDs 40 selectively turned on in each sub-array are at the same location relative to the center of their corresponding focusing element 38 across the entire array, the output aggregate beam will be steered. If the LEDs 40 selectively turned on in each sub-array are at different locations relative to the center of their corresponding focusing element 38 across the entire array, the output aggregate beam will be broadened.

Incorporating sub-arrays of multiple LEDs 40 associated with each focusing element 38 also creates additional functionality over relative mechanical movements of two arrays. More than one of the multiple LEDs can be turned on simultaneously to increase the effective size of the light source, as shown in FIG. 12D, which has the effect of broadening the output aggregate beam. Different combinations of LEDs 40 can be turned on to create multiple beams, asymmetric beams, and other complex beam patterns. The multiple LEDs 40 can also be selectively dimmed to create different gradations in the luminous intensity profile of the output beams.

Using sub-arrays of multiple LEDs 40 (or other solid-state light emitters) will result in beam steering and broadening that occurs in discrete steps corresponding to the size of the light emitters. In static applications requiring fine control over beam steering and broadening or dynamic applications where smooth beam changes are desired, the smallest practical light emitters and controlled dimming of neighboring light emitters should be used to minimize the size of the discrete steps and their abruptness.

Combining Sub-Arrays of Multiple Emitters and Mechanical Actuation

Sub-arrays of multiple LEDs 40 corresponding to each focusing element 38 can be combined with the relative mechanical movement of the array of focusing elements 38 to create new product value.

One or more axes of movement can be replaced by the functionality of selectively energizing the multiple LEDs 40 in each sub-array, simplifying and reducing the operating volume of the mechanical actuation system. In one embodiment, the actuation system can be comprised of mechanical translations to steer the beam and omit rotations, relying solely on the multiple light emitters to shape the beam.

Figure 13:
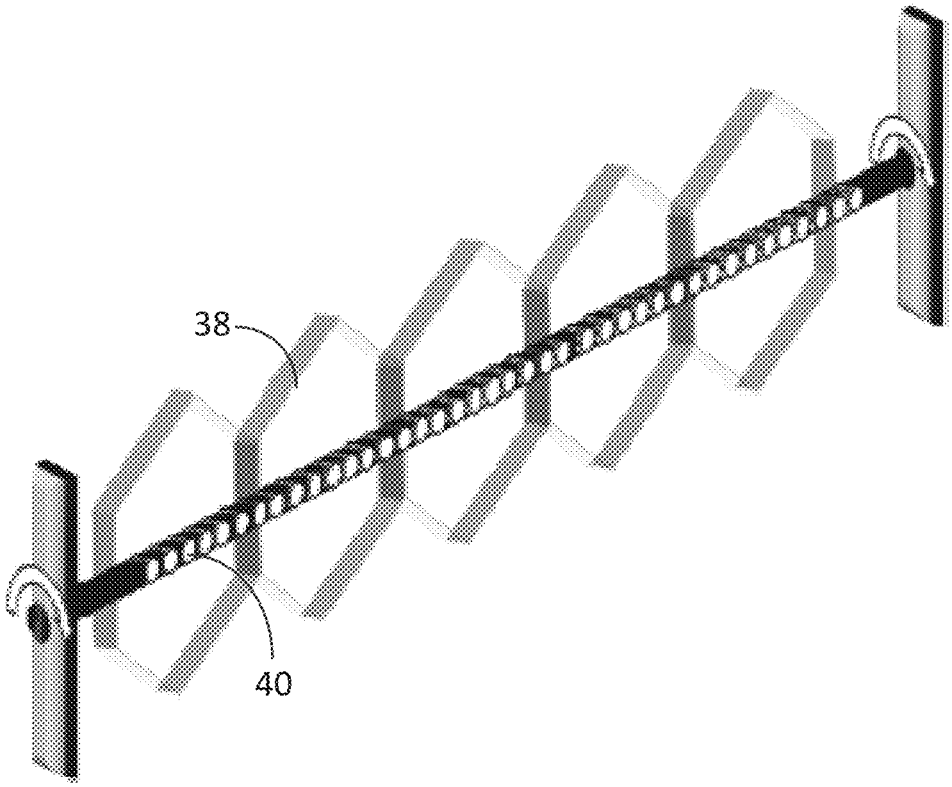
FIG. 13 is a perspective view of a luminaire similar to that of FIG. 10 where the entire luminaire is rotatable around a pivot to steer the aggregate beam in a wider variety of ways.

In another embodiment shown in FIG. 13, the actuation system can be comprised of mechanical rotation of the entire luminaire in one axis and sub-arrays of multiple LEDs 40 can be aligned along a second perpendicular axis, providing for two axes of beam steering that minimizes the operating volume necessary in the second axis, e.g. in a linear luminaire where it is desired to have a long and narrow form factor.

Variations of Configurable Luminaire

Many designs are possible in order to provide desired control over beam steering and shape. Several examples are listed below.

Figure 14:
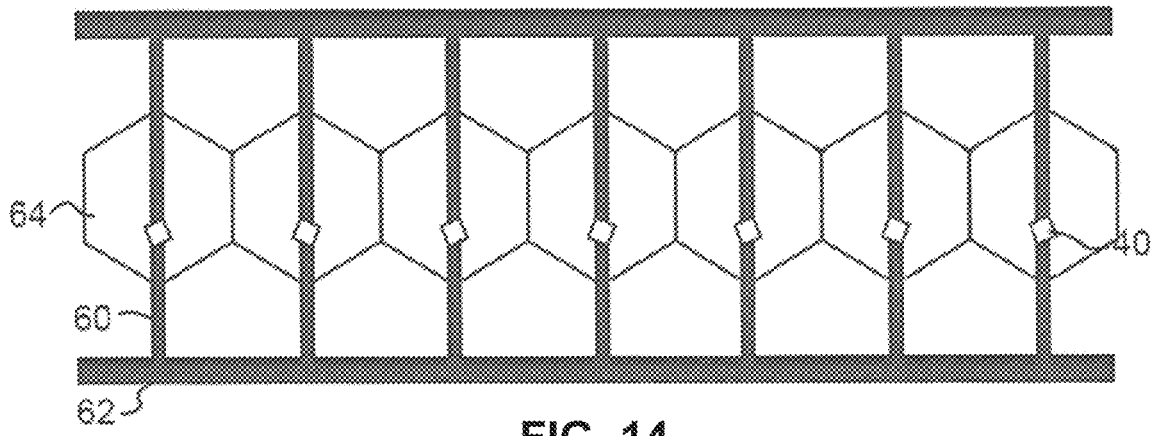
FIG. 14 is similar to FIG. 5B, except that the LEDs are mounted away from the center of the support structures, resulting in an aggregate beam that is tilted away from the normal to the plane of the focusing elements when the support structures and focusing elements are centered with respect to each other.

FIG. 14 shows an example similar to FIG. 5B, except that the LEDs 40 are all offset from the center of their respective support structures 60. When the support structures 60 and focusing elements 64 are centered with respect to each other, the aggregate beam emitted by the luminaire will be tilted at an angle away from the normal to the plane of the focusing elements 64. The beam can be steered by relative movement of the focusing elements and the LED array, as in FIG. 5B, but for equivalent amount of motion the range of angles over which the beam will be steered is changed. The example of FIG. 5B steers the beam over a range of angles that is centered on the normal to the plane of the focusing elements 64; in a downward-facing, ceiling-mounted luminaire, this allows the beam to be swept over a range of angles centered around a downward facing beam. The example of FIG. 14, in contrast, steers the beam over a range of angles that is centered on an oblique angle determined by the offset of the LEDs 40 from the center of the support structures 60. This tilted design may be valuable at the edge of a room, where it may be desirable to illuminate the space between the bottom and top of the adjacent wall; following the example of FIG. 14, a downward-facing, ceiling-mounted luminaire could have the center of its beam steering range located near the center of the adjacent wall and illuminate targets between the bottom and top of the wall.

Figure 15A:
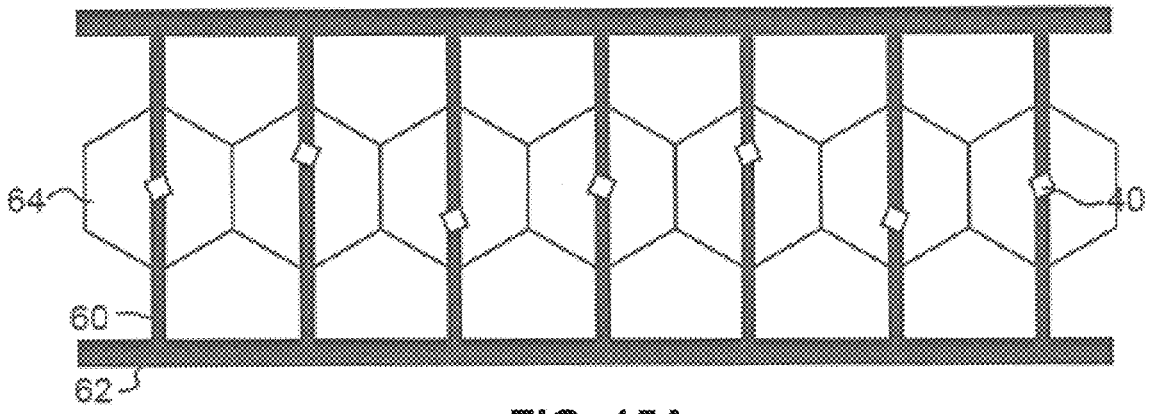
FIG. 15A is similar to FIG. 5B, except that the LEDs are mounted at varying distances away from the center of their respective support structures, resulting in an aggregate beam that is broadened in the direction parallel to the support structures.
Figure 15B:
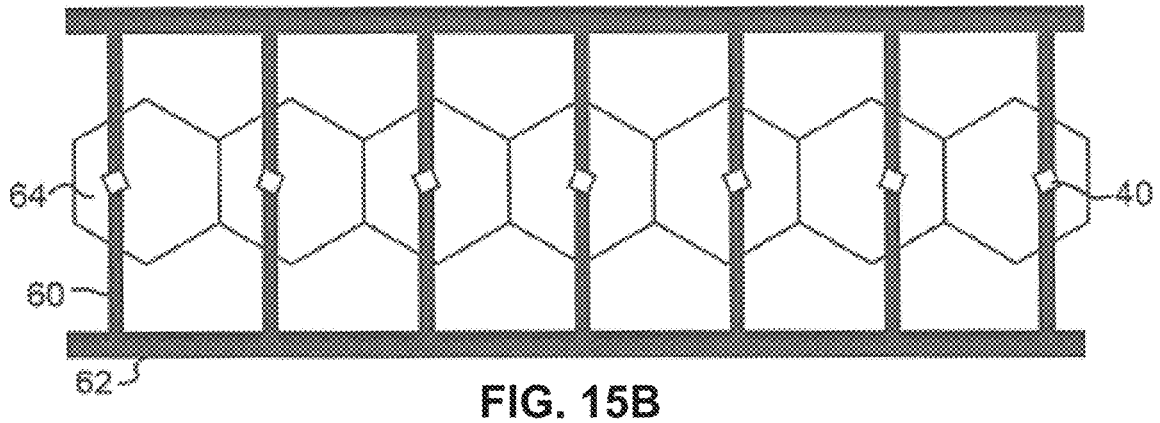
FIG. 15B is similar to FIG. 5B, except that the distance between the support structures is different than the distance between focusing elements along a first common axis, resulting in an aggregate beam that is broadened in the direction parallel to the first common axis.

FIG. 15A and FIG. 15B show examples in which the various LEDs 40 are placed at a range of different locations with respect to each focusing element 64. In FIG. 15A this variation is achieved by placing the LEDs at different locations on the support structures 60, while in FIG. 15B this variation is achieved by making the distance between the support structures 60 different from the distance between focusing elements 64 along a first common axis. The two approaches may also be combined. In either case, the effect is to change the shape of the aggregate beam emitted by the luminaire. Each individual focusing element 64 will produce a beam of light depending upon the relative position of the LED 40 and the focusing element 64. The aggregate light beam emitted by the luminaire will be the sum of all the individual beams. In the examples of FIG. 15A and FIG. 15B, an extended aggregate beam will be generated because of the variation in LED position in one axis. The extended aggregate beam will be oriented perpendicular to the LED array in the case of FIG. 15A and parallel to it in the case of FIG. 15B. A wide variety of aggregate beam shapes and power distribution profiles can be generated through precise control of LED placement using these techniques. The resulting aggregate beam shapes can still be steered using relative motion of the LED array and focusing element array, as described previously.

Figure 16:
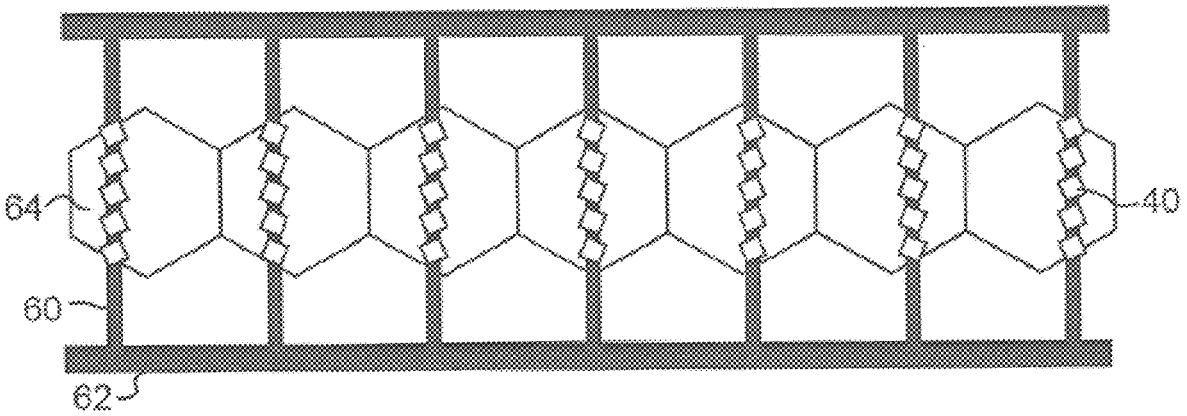
FIG. 16 is similar to FIG. 11, except that the distance between the support structures is different than the distance between focusing elements along a first common axis. Different selections of LEDs may be energized to form different aggregate beam shapes. Alternatively, different selections of LEDs may be energized to coarsely steer an aggregate beam without necessarily mechanically translating the support structures with respect to the focusing elements.

FIG. 16 shows an example in which the distance between support structures 60 is different from the distance between focusing elements 64, as measured along a first common axis. On each support arm 60 there is a sub-array of LEDs 40, arrayed along a second orthogonal common axis. As a result, different LEDs 40 are positioned differently with regard to their associated focusing elements 64 in two axes. Each LED 40, if energized, will result in a beam of light that exits the luminaire at an angle determined by the relative position of that LED 40 and the focusing element 64 with which it is associated. By selectively energizing individual LEDs on specific support arms, an arbitrary pattern of light beams may be emitted, with control over aggregate beam shape and direction in two axes. This design can provide for aggregate beam shaping and steering without the use of moving parts. Alternatively, the design can be used for coarse aggregate beam steering via selective energizing of LEDs, with fine steering still provided by relative motion of the array of focusing elements 64 and the array of LEDs 40.

Figure 17A:
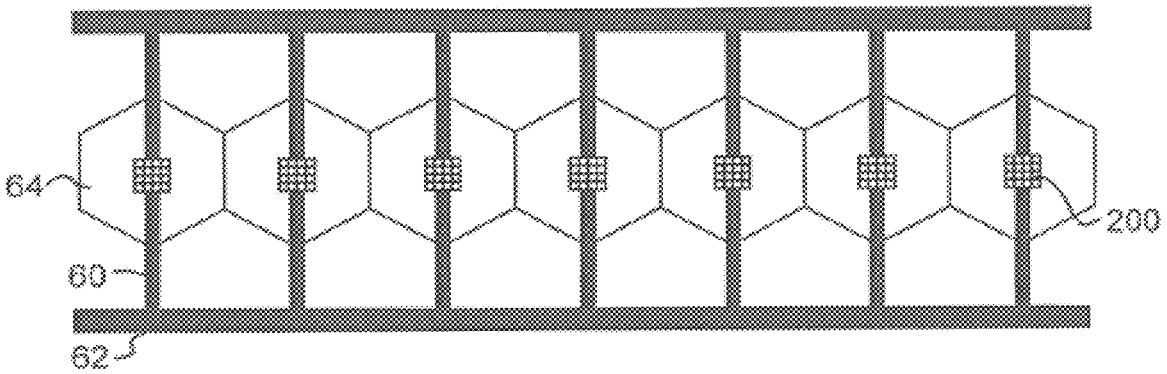
FIG. 17A is similar to FIG. 5A, except that the light sources are replaced by compact arrays of very small micro-LEDs. Aggregate beam shape and intensity may be varied by varying the selection of micro-LEDs that are energized in each compact array of micro-LEDs.

FIG. 17A shows an example in which a two-dimensional sub-array of LEDs 200 is associated with each focusing element 64. For example, the two-dimensional sub-array may be formed of small "micro-LEDs." By selectively energizing the LEDs 200 in the two-dimensional sub-array, a beam of variable width and shape can be emitted by the luminaire. The LEDs energized within the two-dimensional sub-array may be identical in each sub-array, or may be made to vary for finer control over aggregate beam shape and intensity. Some beam steering may be achieved by selectively energizing LEDs in the array, and further steering may be achieved by relative motion of the focusing element array 64 and the LED array.

Figure 17B:
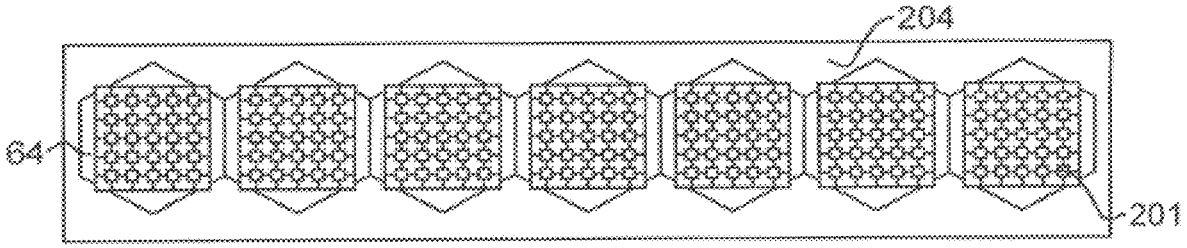
FIG. 17B is similar to FIG. 5A, except that the light sources are replaced by arrays of LEDs that cover the majority of the area of their respective focusing elements. Aggregate beam shape, intensity, and direction may be varied by varying the selection of LEDs that are energized in each array of LEDs.

FIG. 17B shows a similar design implemented on with a support structure in the form of a transparent sheet 204. The transparent sheet 204 allows the two-dimensional sub-array 201 of LEDs to be sparse and therefore spread over a larger area of the associated focusing element while minimizing shadowing. This design can provide greater control over aggregate beam shape and steering via selection of LEDs within the sub-arrays 201 to energize.

Most embodiments described so far have been described with the use of concave reflectors as the focusing elements. However, these inventions can also be implemented with refractive lenses as the focusing elements.

Figure 17C:
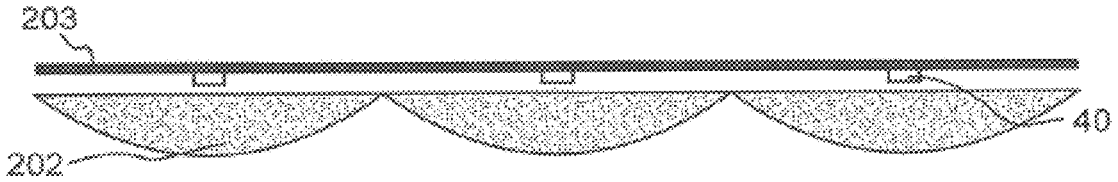
FIG. 17C is similar to FIG. 3, except that the focusing elements are transparent refractive lenses instead of concave mirrors.

FIG. 17C shows a side-view of an example in which an array of refractive lenses 202 is used as the focusing elements. The orientation of LEDs 40 on support structure 203 may be varied according to the concept demonstrated in FIG. 5B to achieve a round aggregate beam.

Figure 17D:
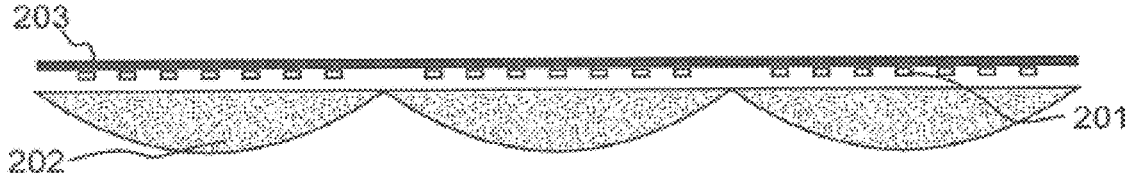
FIG. 17D is similar to FIG. 3, except multiple LEDs are arranged in sub-arrays that span across the area of each refractive lens.

FIG. 17D shows a side-view of an example of two-dimensional sub-arrays of LEDs 201 used with an array of refractive lenses 202 as focusing elements. Beam shadowing is not a concern in the case of refractive focusing elements 202, so the LEDs in the sub-arrays of LEDs 201 may be spread over as much area of the associated refractive lens 202 as desired, and may be placed upon a planar thermally-conductive substrate as a support structure 203 without regard to transparency. By selectively energizing the LEDs in the two-dimensional sub-arrays, a beam of variable width, shape, and steering can be emitted by the luminaire. The LEDs energized within the two-dimensional sub-array may be identical in each sub-array, or may be made to vary for finer control over aggregate beam shape. Coarse aggregate beam steering may be achieved by selectively energizing LEDs in the array, and fine steering may be achieved by relative motion of the focusing element array and the LED array.

Secondary Optics Incorporated on the Emitters

Secondary optics may be incorporated on the sub-arrays of multiple LEDs 40 to tailor light emission patterns for optimal beam quality. The secondary optics may be small lenses affixed over the LEDs 40 to provide a Lambertian pattern (e.g., a hemispherical lens), a collimated pattern (e.g., a bullet shaped lens), or any other emission pattern from the light source. In some embodiments, refractive secondary optics incorporated on the LEDs 40 and a focusing elements array composed of reflective elements form a catadioptric system.

In one embodiment, the secondary optics features the same optical design for every LED in each sub-array. The optical design may be used to adjust the light emission from the LEDs so that the focusing elements can better capture and collimate the light emission into output beams, or to create an asymmetric luminance pattern in the output beam, or to otherwise change the beam characteristics or system efficiency.

In another embodiment, secondary optics can be used to minimize cross-talk during steering. Some light emission from an LED may not be collected by its nearest focusing element, but instead can travel to a neighboring focusing element, which is referred to as cross-talk. Light involved in cross-talk results in misdirected light that generally falls outside the desired aggregate beam, resulting in undesirable loss of efficiency and beam quality. Secondary optics can be used to limit the amount of light emitted at angles that are susceptible to cross-talk.

In another embodiment, secondary optics of varying optical design can be affixed over the individual LEDs in the sub-arrays to create a different beam shape from each LED. The shape of the steerable aggregate beam can be changed by selectively turning on the individual LED in each sub-array with the desired beam shape. Additional aggregate beam shapes can be produced by turning on different LEDs in each sub-array, resulting in a blending of the different individual emitter beam shapes. Mechanical actuation of the focusing elements array can additionally be implemented to provide steering of the adjustable aggregate beam.

These examples are not exhaustive, and other useful implementations of the configurable luminaire will be evident to those skilled in the art.

Actuator for Translating Focusing Element Array

Adjustment of the beam properties is achieved by altering the relative placement and orientation of the focusing element array and the LED array. Many mechanical configurations are possible for manual or motorized adjustment of the relative location for these two pieces. For example, the focusing element array may be moved relative to the LED array by hand, either by sliding it directly or with any sort of handle attachments. For example, a handle attachment protruding from the focusing element array could be combined with a pivot to provide a joystick-type actuation mechanism.

Figure 18:
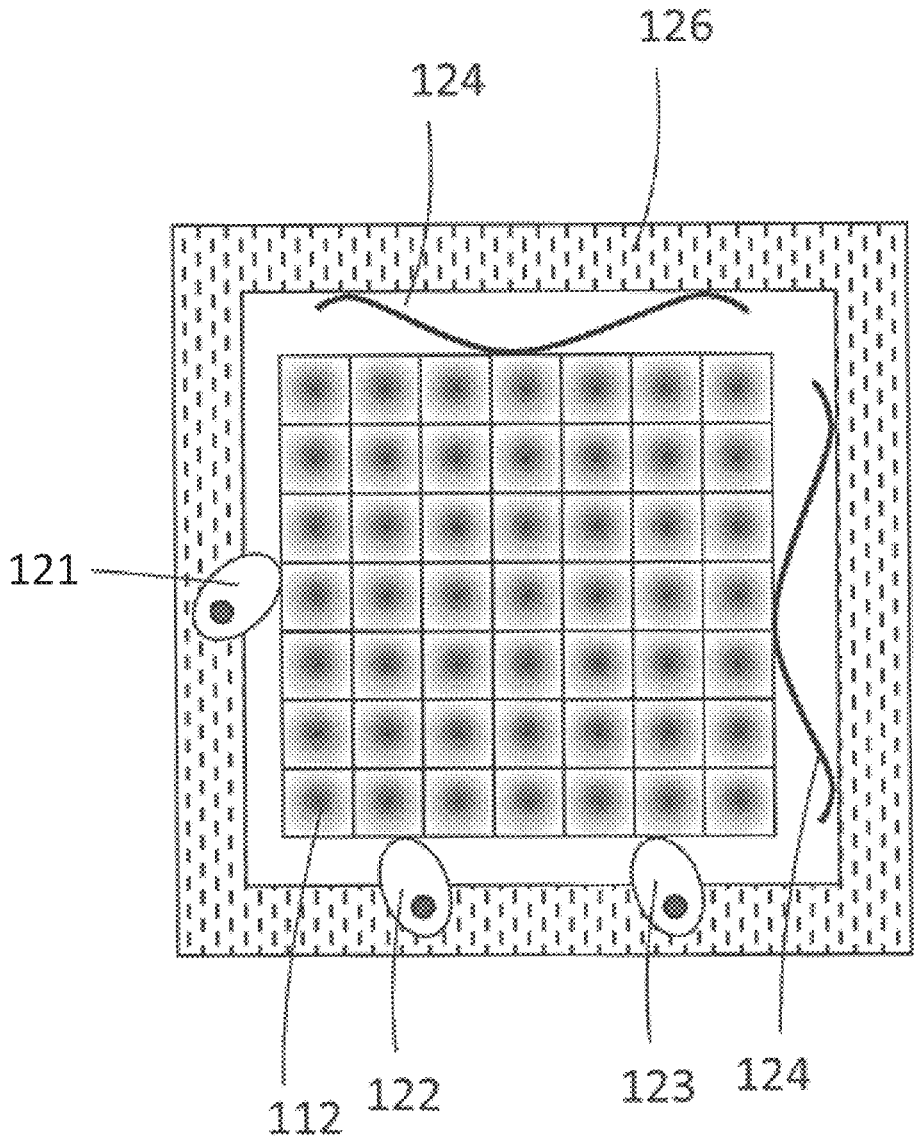
FIG. 18 is a front view of an actuator that may X-Y translate or rotate the collimating mirror array in any of the embodiments to steer the aggregate beam.

Another example is shown in FIG. 18. The focusing element array 112 is in contact with three cams (121, 122, and 123) mounted to stationary frame 126. The array 112 is held against the cams by leaf springs 124. One side of the array 112 is in contact with a single cam 121. The rotational position of this cam controls translation of the array 112 in one axis (the "x" axis in FIG. 18). A perpendicular side of the array 112 is in contact with two cams 122 and 123. The "y" axis translation of the array 112 is controlled by adjusting cams 122 and 123 together and is set by their average extension, while twist rotation of the lens array is controlled by adjusting cams 122 and 123 separately and is set by the difference between the extension of these two cams. The cams may be connected to knobs for manual control over beam direction and width, or connected to motors for automated control. FIG. 18 depicts the cams and leaf springs in contact with the edges of the edges of the array 112, but they could also act on the array 112 from other locations, for example on small protrusions attached to the center of the reflector array. Such a design would provide a more compact luminaire form factor by allowing the cams and leaf springs to fit within the perimeter of the reflector array. For visual clarity, the LED array and support structures are omitted from FIG. 18, but are fixed in position over the apertures of the focusing element array 112.

The general inventions disclosed herein include, but are not limited to, the following:

COVERS FIGS. 10-13, 16, 17. An optical system for generating light comprising:

an array of concave mirrors for receiving light, each mirror having an aperture;

an array of light sources positioned at approximately a focal plane of the array of mirrors, the array of light sources comprising sub-arrays of light sources that can emit light toward an associated one of the mirrors, wherein a light beam reflected off the associated one of the mirrors has a shape controlled by selecting a particular one or more light sources in the associated sub-array; and a controller for supplying power to selected one or more light sources in the sub-arrays for controlling a light emission shape from each of the mirrors.

COVERS FIGS. 4B AND 4C. An optical system for generating light comprising:

an array of concave mirrors for receiving light, each mirror having an aperture;

an array of light sources positioned at approximately a focal plane of the array of mirrors, the array of light sources comprising one or more light sources supported over each of the apertures of the mirrors by a heat-sinking support structure, the support structures comprising cantilevered arms extending over the apertures; and an actuator for controlling relative movement between the array of mirrors and the array of light sources, wherein a light beam emitted by one of the light sources reflected off its associated mirror has a shape and direction controlled by the relative movement between the array of mirrors and the array of light sources.

The above system wherein the cantilevered arms are at a variety of angles to vary a position of shadows in the associated beams caused by light blockage by the cantilevered arms.

COVERS FIG. 6. An optical system for generating light comprising:

an array of concave mirrors for receiving light, each mirror having an aperture;

an array of light sources positioned at approximately a focal plane of the array of mirrors, the array of light sources comprising one or more light sources supported over each of the apertures of the mirrors by a heat-sinking transparent support structure; and an actuator for controlling relative movement between the array of mirrors and the array of light sources, wherein a light beam emitted by one of the light sources reflected off its associated mirror has a shape and direction controlled by the relative movement between the array of mirrors and the array of light sources.

COVERS FIGS. 7-9. An optical system for generating light comprising:

an array of concave mirrors for receiving light, each mirror having an aperture;

an array of light sources positioned at approximately a focal plane of the array of mirrors, the array of light sources comprising an array of separate lightguides directing light towards associated ones of the mirrors; and an actuator for controlling relative movement between the array of mirrors and the array of light sources, wherein a light beam emitted by one of the light sources reflected off its associated mirror has a shape and direction controlled by the relative movement between the array of mirrors and the array of light sources.

COVERS FIGS. 14 and 15. An optical system for generating light comprising:

an array of concave mirrors for receiving light, each mirror having an aperture;

an array of light sources positioned at approximately a focal plane of the array of mirrors, wherein the light sources are located at a variety of positions over the mirror apertures so as to create different light beams emitted from different ones of the mirrors; and an actuator for controlling relative movement between the array of mirrors and the array of light sources, wherein a light beam emitted by one of the light sources reflected off its associated mirror has a shape and direction controlled by the relative movement between the array of mirrors and the array of light sources.

While particular embodiments of the present invention have been shown and described, it will be obvious to those skilled in the art that changes and modifications may be made without departing from this invention in its broader aspects and, therefore, the appended claims are to encompass within their scope all such changes and modifications.

What is claimed is:

1. An optical system for generating light comprising:

an array of concave mirrors for receiving light, each mirror having an aperture; and an array of light sources positioned at approximately a focal plane of the array of concave mirrors, wherein the light sources have a variety of concurrently different orientations with respect to their associated mirror apertures so as to concurrently create different light beams emitted from different ones of the mirrors that combine into an aggregate beam.

2. The system of claim 1 wherein the light sources comprise light emitting diodes (LEDs).

3. The system of claim 1 wherein optical centers of the light sources are located at substantially identical positions over the mirror apertures, and wherein rotational orientations of the light sources are varied within the array of light sources.

4. The system of claim 1 wherein positions of the light sources relative to their associated mirror apertures are varied.

5. The system of claim 1 further comprising an actuator to control a relative position of the array of concave mirrors with respect to the array of light sources.

6. The system of claim 1 wherein the concave mirrors comprise a reflective coating on a transparent solid material with a planar surface opposite the reflective coating.

7. An optical system for generating light comprising:

an array of concave mirrors for receiving light, each mirror having an aperture;

an array of light sources positioned at approximately a focal plane of the array of concave mirrors, wherein the light sources are variably oriented with respect to their associated mirror apertures so as to create different light beams emitted from different ones of the mirrors; and a support structure for the array of light sources, wherein the support structure comprises arms that support the light sources, and wherein the arms cover only a portion of each aperture of the concave mirrors.

8. The system of claim 1 further comprising a support structure for the array of light sources, wherein the support structure comprises a transparent substrate.

9. The system of claim 8 wherein the light sources comprise light emitting diodes (LEDs), wherein conductive traces are provided on the transparent substrate between the LEDs and a controller for supplying power to the LEDs.

10. The system of claim 9 wherein the transparent substrate comprises one of plastic, glass, ceramic, or a crystal.

11. The system of claim 10 wherein the transparent substrate sinks heat away from the LEDs.

12. The system of claim 1 further comprising an actuator to control a relative position of the array of concave mirrors with respect to the array of light sources, wherein the actuator controls movement of the array of light sources.

13. An optical system for generating light comprising:

an array of concave mirrors for receiving light, each mirror having an aperture;

an array of light sources positioned at approximately a focal plane of the array of concave mirrors, wherein the light sources are variably oriented with respect to their associated mirror apertures so as to create different light beams emitted from different ones of the mirrors; and an actuator to control a relative position of the array of concave mirrors with respect to the array of light sources, wherein the actuator controls movement of the array of concave mirrors.

14. The system of claim 1 wherein the concave mirrors have hexagonal apertures.

15. The system of claim 1 wherein the light sources comprise light emitting diodes (LEDs) having rectangular shapes, and wherein the LEDs are mounted on a support structure so as to have different orientations such that edges of the LEDs are not all parallel or perpendicular to one another.

* * * * *